US008608557B2

(12) United States Patent
Oiwa

(10) Patent No.: US 8,608,557 B2
(45) Date of Patent: Dec. 17, 2013

(54) BETTING TICKET PURCHASE SYSTEM, METHOD OF CONTROLLING A BETTING TICKET PURCHASE SYSTEM, PROGRAM, AND RECORDING MEDIUM

(75) Inventor: Suguru Oiwa, Shinagawa-ku (JP)

(73) Assignee: Rakuten, Inc., Tokyo (JP)

( * ) Notice: Subject to any disclaimer, the term of this patent is extended or adjusted under 35 U.S.C. 154(b) by 0 days.

(21) Appl. No.: 13/988,906

(22) PCT Filed: May 25, 2012

(86) PCT No.: PCT/JP2012/063546

§ 371 (c)(1),
(2), (4) Date: May 22, 2013

(87) PCT Pub. No.: WO2013/001952

PCT Pub. Date: Jan. 3, 2013

(65) Prior Publication Data

US 2013/0244768 A1 Sep. 19, 2013

(30) Foreign Application Priority Data

Jun. 30, 2011 (JP) ..... 2011-146592

(51) Int. Cl.
*A63F 9/24* (2006.01)

(52) U.S. Cl.
USPC ..... 463/28; 463/25

(58) Field of Classification Search
USPC ..... 463/25, 28
See application file for complete search history.

(56) References Cited

U.S. PATENT DOCUMENTS

| | | | | |
|---|---|---|---|---|
| 5,672,106 | A * | 9/1997 | Orford et al. | 463/28 |
| 8,370,249 | B2 * | 2/2013 | Lange et al. | 705/37 |
| 2005/0004859 | A1 | 1/2005 | Kanazawa et al. | |
| 2008/0207310 | A1 * | 8/2008 | Mindes | 463/25 |

FOREIGN PATENT DOCUMENTS

WO 03/067483 A1 8/2003

* cited by examiner

*Primary Examiner* — Corbett B Coburn
(74) *Attorney, Agent, or Firm* — Sughrue Mion, PLLC

(57) ABSTRACT

Provided is a betting ticket purchase system capable of avoiding a time lag between the reception of a purchase request that changes the odds greatly and the reflection of the specifics of the purchase request on a change in the odds . A betting request receiving unit (26) receives a purchase request for a betting ticket. An odds outputting unit (24) outputs odds which are calculated based on specifics of the purchase request. The betting request receiving unit (26) identifies a level of impact of the purchase request on the odds based on the specifics of the purchase request. The betting request receiving unit (26) sets a processing order of the purchase request so that the purchase request is processed before a purchase request that is identified as being smaller in impact on the odds than the purchase request.

12 Claims, 6 Drawing Sheets

FIG.3

| RACE ID | BETTING METHOD | BET SELECTION | PURCHASED AMOUNT | USER ID | PROCESSED DATE | RECEPTION NUMBER | SERIAL BETTING CASE NUMBER | RECEPTION ESTABLISHED DATE/TIME |
|---|---|---|---|---|---|---|---|---|
| 10 | WIN | 3 | 4,000 | a001 | 20110626 | 13145 | 01 | 20110626150623 |
| 11 | WIN | 5 | 5,000 | b003 | 20110626 | 37165 | 01 | |

30

30

| LATEST ODDS RANGE | IMPACT SCORE VALUE |
|---|---|
| LESS THAN 2.0 | 0 |
| 2.0 TIMES OR MORE AND LESS THAN 5.0 TIMES | 2 |
| 5.0 TIMES OR MORE AND LESS THAN 10.0 TIMES | 4 |
| 10.0 TIMES OR MORE AND LESS THAN 20.0 TIMES | 6 |
| 20.0 TIMES OR MORE AND LESS THAN 100 TIMES | 8 |
| 100 TIMES OR MORE | 10 |

44

BETTING TICKET PURCHASE SYSTEM, METHOD OF CONTROLLING A BETTING TICKET PURCHASE SYSTEM, PROGRAM, AND RECORDING MEDIUM

CROSS REFERENCE TO RELATED APPLICATIONS

This application is a National Stage of International Application No. PCT/JP2012/063546, filed on May 25, 2012, which claims priority from Japanese Patent Application No. 2011-146592, filed on Jun. 30, 2011, the contents of all of which are incorporated herein by reference in their entirety.

TECHNICAL FIELD

The present invention relates to a betting ticket purchase system, a method of controlling a betting ticket purchase system, a program, and a recording medium.

BACKGROUND ART

There are betting ticket purchase systems that process requests to purchase betting tickets such as horse race betting tickets or football betting tickets in a given order. An example of technology for processing requests to purchase betting tickets is disclosed in Patent Literature 1, where a request from a terminal, such as a purchase request, is registered by adding to the tail end of a queue, and requests are taken out of the queue in order from the head of the queue to be processed. It is a common practice in this type of betting ticket purchase system to present to users the latest odds calculated based on the specifics of purchase requests, such as bet amounts and bet selections, for users' information.

CITATION LIST

Patent Literature

[Patent Literature 1] WO 2003/067483 A1

SUMMARY OF INVENTION

Technical Problem

The odds change greatly or not so much, depending on the specifics of a betting ticket purchase request. However, with the technology of Patent Literature 1 and other technologies where betting ticket purchase requests are processed in the received order, a purchase request that changes the odds greatly is not processed until the processing of purchase requests that have been received prior to this purchase request is finished, and the specifics of this purchase request is not reflected on the latest odds. The failure to quickly inform users of a change in the odds inconveniences users.

The present invention has been made in view of the problem described above, and an object of the present invention is to avoid a time lag between the reception of a purchase request that changes the odds greatly and the reflection of the specifics of the purchase request on a change in the odds.

Solution to Problem

In order to solve the above-mentioned problem, according to the present invention, there is provided a betting ticket purchase system, including: receiving means for receiving a purchase request for a betting ticket; odds outputting means for outputting odds which are calculated based on specifics of the purchase request;

identifying means for identifying a level of impact of the purchase request on the odds based on the specifics of the purchase request; and setting means for setting a processing order of the purchase request so that the purchase request is processed before a purchase request that is identified as being smaller in impact on the odds than the purchase request.

Further, according to the present invention, there is provided a method of controlling a betting ticket purchase system, the method including: a receiving step of receiving a purchase request for a betting ticket; an odds outputting step of outputting odds which are calculated based on specifics of the purchase request; an identifying step of identifying a level of impact of the purchase request on the odds based on the specifics of the purchase request; and a setting step of setting a processing order of the purchase request so that the purchase request is processed before a purchase request that is identified as being smaller in impact on the odds than the purchase request.

Further, according to the present invention, there is provided a program for causing a computer to function as: receiving means for receiving a purchase request for a betting ticket; odds outputting means for outputting odds which are calculated based on specifics of the purchase request; identifying means for identifying a level of impact of the purchase request on the odds based on the specifics of the purchase request; and setting means for setting a processing order of the purchase request so that the purchase request is processed before a purchase request that is identified as being smaller in impact on the odds than the purchase request.

Further, according to the present invention, there is provided a recording medium having recorded thereon a program for causing a computer to function as: receiving means for receiving a purchase request for a betting ticket; odds outputting means for outputting odds which are calculated based on specifics of the purchase request; identifying means for identifying a level of impact of the purchase request on the odds based on the specifics of the purchase request; and setting means for setting a processing order of the purchase request so that the purchase request is processed before a purchase request that is identified as being smaller in impact on the odds than the purchase request.

According to the present invention, the order of processing purchase requests is set so that a purchase request is processed before purchase requests that are identified as being smaller in impact on the odds than the purchase request, thereby avoiding a time lag between the reception of a purchase request that changes the odds greatly and the reflection of the specifics of the purchase request on a change in the odds.

In an aspect of the present invention, the setting means sets the processing order so that the purchase request is processed first among unprocessed purchase requests under the condition that the level of impact of the purchase request on the odds is higher than a predetermined level, and otherwise sets the processing order so that the purchase request is processed last among the unprocessed purchase requests.

Further, in an aspect of the present invention, under the condition that the processing order of a first purchase request is set so that the first purchase request is processed later than a second purchase request which is identified as being smaller in impact on the odds than the first purchase request, the setting means changes places of the first purchase request and the second purchase request in the processing order.

Further, in an aspect of the present invention, the betting ticket purchase system further includes obtaining means for obtaining latest odds from a system that provides information on the latest odds of the betting ticket, in which the setting means sets the processing order of the purchase request so that the purchase request is processed before a purchase request for abetting ticket for a bet selection whose latest odds obtained from the obtaining means are lower than the latest odds of the purchase request.

Further, in an aspect of the present invention, the setting means sets the processing order of the purchase request so that the purchase request is processed before a purchase request for a betting ticket that is specified in advance as being lower in odds than the purchase request.

Further, in an aspect of the present invention, the setting means sets the processing order of the purchase request so that the purchase request is processed before a purchase request for a betting ticket that is lower in bet amount than the purchase request.

Further, in an aspect of the present invention, under the condition that there are more unprocessed purchase requests than a given number, the setting means sets the processing order of a purchase request received by the receiving means so that the purchase request is processed last among the unprocessed purchase requests irrespective of the level of impact of the purchase request on the odds.

BRIEF DESCRIPTION OF DRAWINGS

In the accompanying drawings:

FIG. 3 is a diagram illustrating an example of betting transaction detail information.

DESCRIPTION OF EMBODIMENT

An embodiment of the present invention is described in detail below with reference to the drawings.

Figure 1:
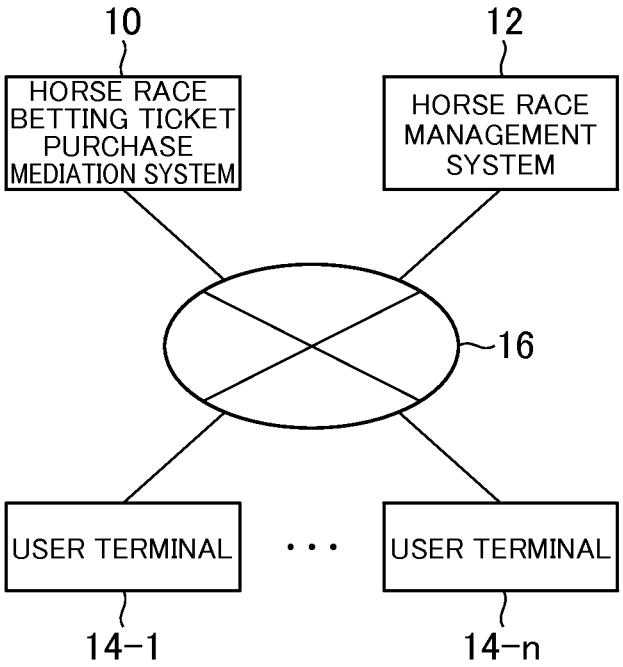
FIG. 1 is an overall configuration diagram of a computer network according to an embodiment of the present invention.

FIG. 1 is an overall configuration diagram of a computer network according to the embodiment of the present invention. As illustrated in FIG. 1, a horse race betting ticket purchase mediation system 10, a horse race management system 12, and user terminals 14 (14-1 to **14-*n*), which are each configured with a computer as the main component, are connected to the computer network which is the Internet or the like and denoted by 16. The horse race betting ticket purchase mediation system 10, the horse race management system 12, and the user terminals 14** can communicate to/from one another.

The horse race betting ticket purchase mediation system 10 is a computer such as a Web server that functions as a betting ticket purchase system according to this embodiment. The horse race betting ticket purchase mediation system 10 according to this embodiment uses Web technologies to provide a large number of users with Web services such as a service of assisting users in purchasing a horse race betting ticket (in betting) at a horse race that is being held and a data providing service for providing data about a horse race.

The horse race management system 12 is a computer such as a server that is managed by the promoter of a horse race, and implements a function of executing horse race betting ticket purchase processing (betting processing) in response to the reception of a horse race betting ticket purchase request (betting request), a function of determining the odds based on the specifics of a betting request, a function of managing betting situations, a function of executing winning payment processing, and the like.

The horse race betting ticket purchase mediation system 10 according to this embodiment transmits an instruction to execute betting processing to the horse race management system 12 according to this embodiment in response to the reception of a betting request.

The horse race management system 12 executes betting processing in response to the received execution instruction. Bets for which the execution of betting processing can be instructed in one transmission are hereinafter referred to as "betting unit". The horse race betting ticket purchase mediation system 10 in this embodiment is designed so as to be capable of receiving betting requests that translate into a plurality of betting units by requesting betting once. The horse race management system 12 according to this embodiment executes betting processing also under the condition that execution instructions are received from other systems than the horse race betting ticket purchase mediation system 10 according to this embodiment.

The horse race betting ticket purchase mediation system 10 and the horse race management system 12 each include, for example, a control unit which is a program-controlled device such as a CPU that operates as programmed by a program installed in its own machine, a memory unit such as a ROM, a RAM, or other types of memory device, or a hard disk drive, and a communication unit which is a communication interface such as a network board. Those components are connected to one another via a bus. The memory unit of each of the horse race betting ticket purchase mediation system 10 and the horse race management system 12 stores a program that is executed by the control unit of its own machine. The memory unit of each of the horse race betting ticket purchase mediation system 10 and the horse race management system 12 also operates as a work memory of its own machine.

A large number of user terminals 14 which are managed by users of the horse race betting ticket purchase mediation system 10 are also connected to the computer network 16. The user terminals 14 are information processing devices such as personal computers, cellular phones, portable information terminals (personal digital assistants: PDAs), and smartphones. The user terminals 14 each include, for example, a control device such as a CPU, a memory device such as a ROM, a RAM, or other types of memory device, or a hard disk drive, an output device such as a display, an input device such as a mouse, keyboard, a touch pad, or buttons, and a communication device such as a network board. A Web browser is installed in advance in each user terminal 14 according to this embodiment. And the user terminal 14 executes the Web browser. Through the Web browser, the user terminal 14 receives various services provided by the horse race betting ticket purchase mediation system 10. In this embodiment, users of the horse race betting ticket purchase mediation system 10 use the user terminals 14 to take such actions as obtaining information from the horse race betting ticket purchase mediation system 10 and issuing a betting request to the horse race betting ticket purchase mediation system 10.

In this embodiment, a plurality of races having different post times from one another are handled. Bets for a race are closed at a point that precedes the post time by a given length of time (for example, two minutes). The horse race betting ticket purchase mediation system 10 in this embodiment is designed to receive betting requests not only for a race nearing its horse race betting ticket purchase deadline (betting deadline) but also for a race of which betting deadline arrives subsequently.

The horse race management system 12 according to this embodiment calculates the latest odds at given time intervals (or each time betting processing is executed) based on the specifics of betting requests (e.g., bet amounts and bet selections) that are received by the horse race betting ticket purchase mediation system 10 and processed by the horse race management system 12. The horse race management system 12 transmits information on the latest odds of a race for which users can bet via the horse race betting ticket purchase mediation system 10, at given time intervals to the horse race betting ticket purchase mediation system 10. The horse race betting ticket purchase mediation system 10 receives the latest odds information transmitted from the horse race management system 12 and saves the latest odds information in the memory unit of the horse race betting ticket purchase mediation system 10. Under the condition that one of the user terminals 14 transmits a request to output the latest odds to the horse race betting ticket purchase mediation system 10, the horse race betting ticket purchase mediation system 10 transmits the saved latest odds information to the user terminal 14 in response to the output request. The user terminal 14 receives the latest odds information and outputs the information to be displayed on the display. Users can thus know information on the latest odds in this embodiment.

Figure 2:
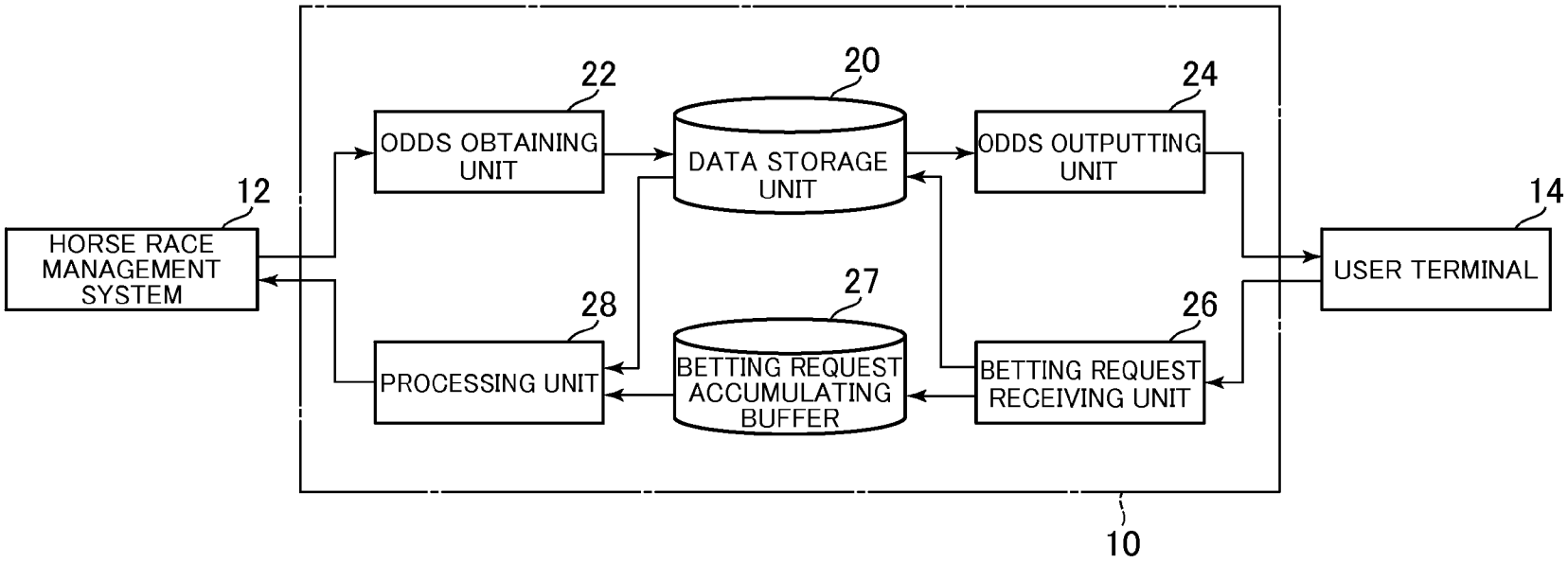
FIG. 2 is a function block diagram illustrating an example of functions implemented in a horse race betting ticket purchase mediation system according to the embodiment of the present invention.

FIG. 2 is a function block diagram illustrating an example of functions relevant to a betting function out of functions that are implemented in the horse race betting ticket purchase mediation system 10 according to this embodiment. Other functions than those illustrated in FIG. 2 are also implemented in the horse race betting ticket purchase mediation system 10 according to this embodiment.

The horse race betting ticket purchase mediation system 10 according to this embodiment includes, in terms of function, a data storage unit 20, an odds obtaining unit 22, an odds outputting unit 24, a betting request receiving unit 26, a betting request accumulating buffer 27, and a processing unit 28. The data storage unit 20 and the betting request accumulating buffer 27 are implemented mainly by the memory unit of the horse race betting ticket purchase mediation system 10. The rest of the components are implemented mainly by the control unit of the horse race betting ticket purchase mediation system 10.

Those components are implemented by executing a program that is installed in the horse race betting ticket purchase mediation system 10, which is a computer, with the control unit of the horse race betting ticket purchase mediation system 10. This program is provided to the horse race betting ticket purchase mediation system 10 via, for example, a computer-readable recording medium such as a CD-ROM or a DVD-ROM, or via a communication network such as the Internet.

The data storage unit 20 in this embodiment stores in advance account data, which includes, among others, a user ID for identifying a user who uses the horse race betting ticket purchase mediation system 10, a password for authenticating the user, and balance information indicating the amount of money paid by the user of the horse race betting ticket purchase mediation system 10 in advance to a business operator who manages the horse race betting ticket purchase mediation system 10 via direct deposit or the like. In this embodiment, one of the user terminals 14 accesses the horse race betting ticket purchase mediation system 10 via the Web browser and transmits a user ID and a password to the horse race betting ticket purchase mediation system 10. Under the condition that this user terminal 14 accesses a Web page disposed in the horse race betting ticket purchase mediation system 10 after the horse race betting ticket purchase mediation system 10 executes login processing (authentication processing) for this user terminal 14, the Web page is displayed on the display of this user terminal 14. The horse race betting ticket purchase mediation system 10 is designed so that, once the user terminal 14 transmits a user ID and a password to the horse race betting ticket purchase mediation system 10, a user ID associated with a user who is using the user terminal 14 can be identified by, for example, referring to authentication information received subsequently from the user terminal 14.

The odds obtaining unit 22 in this embodiment receives latest odds data which is information transmitted from the horse race management system 12 about the latest odds at given time intervals, and saves the latest odds data in the data storage unit 20. In this embodiment, latest odds data is data that associates a race ID for identifying a race and bet selection data indicating a bet selection (for example, win: no. 6, perfecta: no. 3-no. 5) with the latest odds of a bet selection indicated by the bet selection data in a race identified by the race ID. The odds obtaining unit 22 in this embodiment overwrites latest odds data stored in the data storage unit 20 with newly received latest odds data.

The odds outputting unit 24 in this embodiment responds to a latest odds output request received from one of the user terminals 14 by outputting and transmitting to the user terminal 14 that is the sender of the output request a page generated based on latest odds data that has been stored in the data storage unit 20 (for example, a page containing information on a combination of a bet selection and the latest odds of the bet selection in a race nearing its betting deadline). The user terminal 14 receives the page output by the odds outputting unit 24, and outputs the page via the Web browser to the display to be displayed.

The betting request receiving unit 26 in this embodiment receives betting requests from the user terminals 14. Each betting request contains, for example, a race ID for identifying a race, a betting method (method type), a bet selection, and a purchased amount (bet amount). In response to the reception of a betting request, the betting request receiving unit 26 in this embodiment generates at least one piece of betting transaction detail information 30 an example of which is illustrated in FIG. 3, and outputs the betting transaction detail information 30 to the data storage unit 20. The betting transaction detail information 30 includes the information described above which is received from the relevant user terminal 14 and information set by the horse race betting ticket purchase mediation system 10 (for example, the user ID of a user who is making the betting request, a processed date, a reception number, a serial betting case number, and a reception established date/time). The betting transaction detail information 30 in this embodiment is generated on a betting unit-by-betting unit basis. In this embodiment, a date on which the betting request is received and betting processing is executed for the betting request by the horse race management system 12 is set as the value of a processed date included in the betting transaction detail information 30. A reception number included in the betting transaction detail information 30 is a number for identifying the betting request. The same reception number is assigned to pieces of the betting transaction detail information 30 that are associated with one session of requesting betting. For pieces of the betting transaction detail information 30 that have the same processed date, reception numbers are set in ascending order of the reception of betting requests. Among pieces of the betting transaction detail information 30 that have the same combination of a processed date and a reception number, a unique number is assigned to one betting unit as a serial betting case number. The betting transaction detail information 30 in this embodiment is identified uniquely by a combination of a processed date, a reception number, and a serial betting case number. The betting transaction detail information 30 in the initial state includes nil as the value of a reception established date/time. Once a betting request that is associated with the betting transaction detail information 30 is processed, a value is set as a reception established date/time which is described later. Accordingly, whether or not a betting request associated with the betting transaction detail information 30 has been processed (in other words, whether or not the betting request is unprocessed) can be determined by whether or not the betting transaction detail information 30 includes a value as the reception established date/time.

Figure 4:
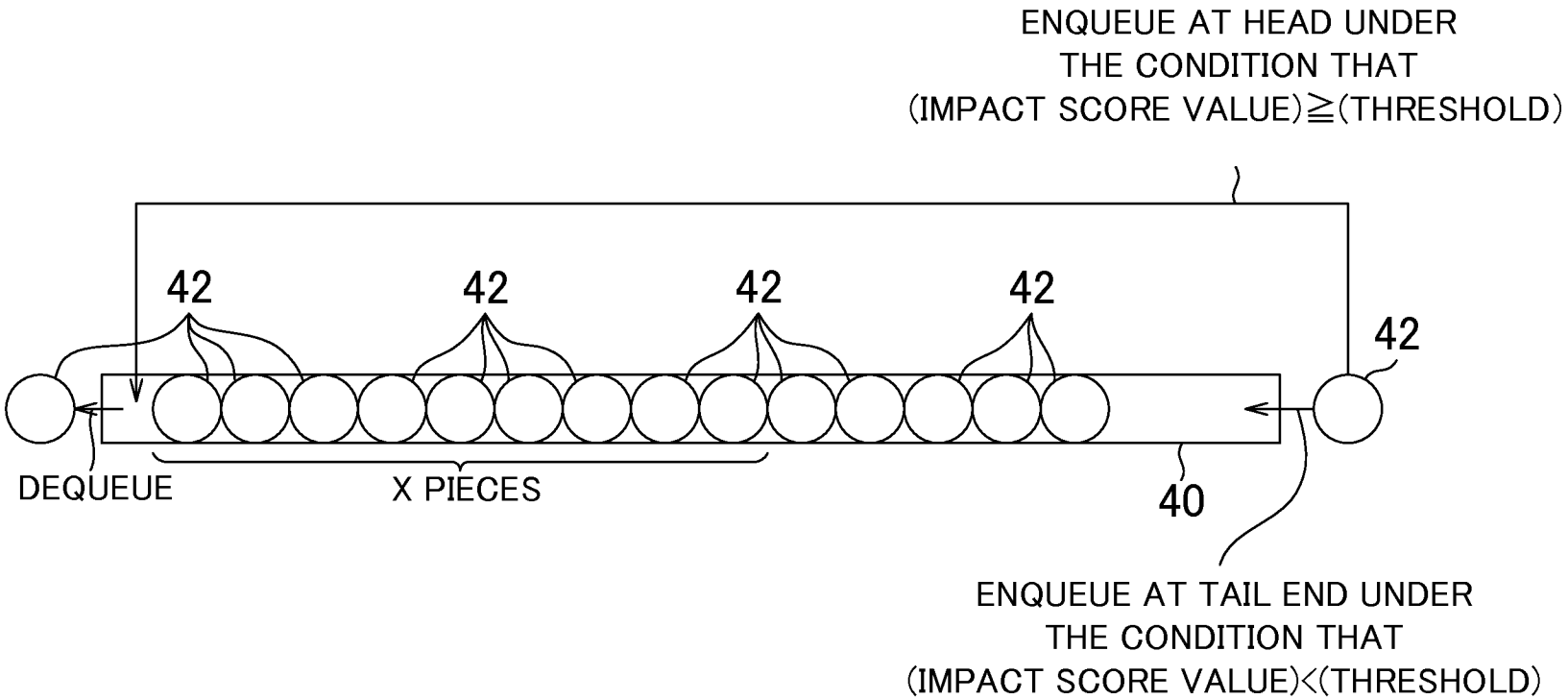
FIG. 4 is a diagram schematically illustrating an example of a betting request management queue.

The betting request accumulating buffer 27 in this embodiment stores a betting request management queue 40 which is a queue for managing the processing order of betting requests. FIG. 4 is a diagram schematically illustrating an example of the betting request management queue 40. The betting request receiving unit 26 in this embodiment generates the betting transaction detail information 30 in the manner described above in response to the reception of abetting request and, at the same time, adds (enqueues) processing order management data 42 that is associated with the betting request to the betting request management queue 40. The betting request management queue 40 in FIG. 4 is expressed so that pieces of the processing order management data 42 contained in the betting request management queue 40 are arranged from left to right in order. In other words, the leftmost processing order management data 42 corresponds to the head processing order management data 42 and the rightmost processing order management data 42 corresponds to the tail end processing order management data 42. The processing order management data 42 in this embodiment includes a reception number and the value of an impact score, which is described later, so that at least one piece of the betting transaction detail information 30 can be identified based on the processing order management data 42.

Figure 5:
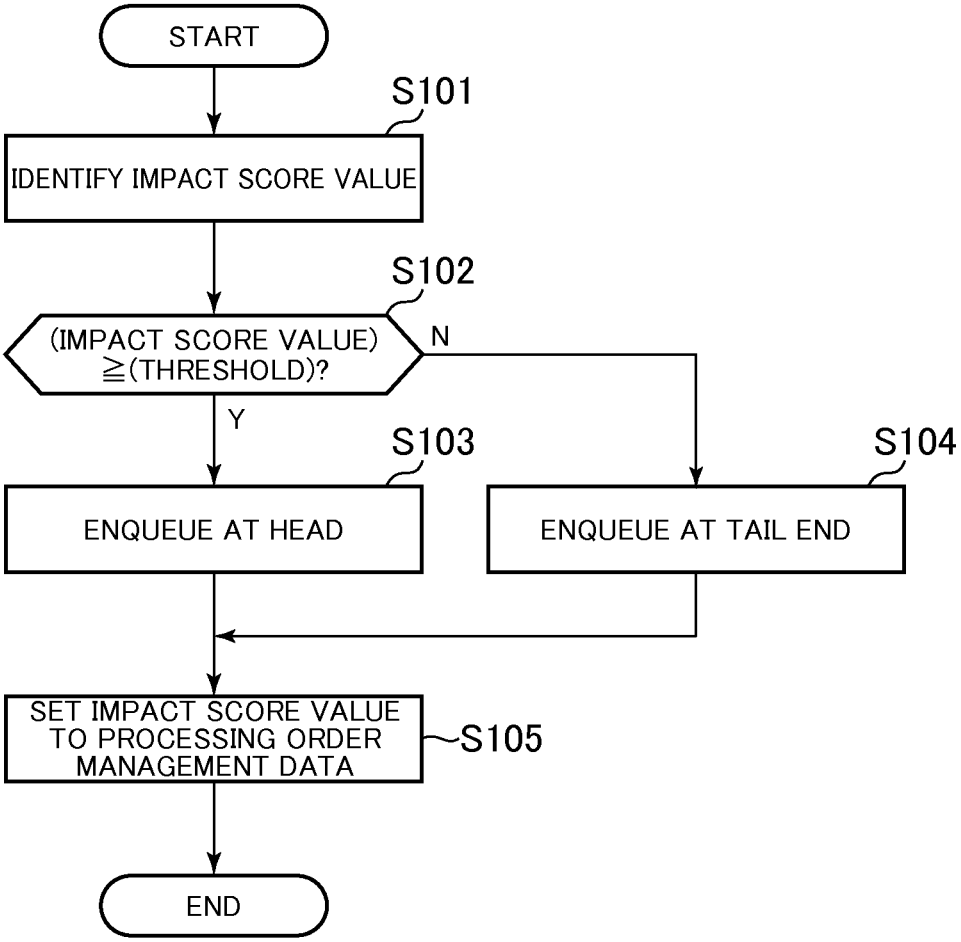
FIG. 5 is a flow chart illustrating an example of the flow of processing that is executed in the horse race betting ticket purchase mediation system according to the embodiment of the present invention.

In this embodiment, in response to the reception of abetting request, the betting transaction detail information 30 is generated in the manner described above, and the processing order management data 42 that is associated with the betting request is added (enqueued) to the head or tail end of the betting request management queue 40. An example of the flow of enqueue processing which is executed by the betting request receiving unit 26 of the horse race betting ticket purchase mediation system 10 according to this embodiment is now described with reference to a flow chart of FIG. 5.

At first, the betting request receiving unit 26 responds to the reception of a betting request by identifying the value of an impact score, which indicates the level of impact of the betting request on the odds of a race that is a betting target of the betting request (S101). In this embodiment, a larger value is set as the value of the impact score for a betting request that has a higher level of impact on the odds . The processing of identifying the impact level is described later. The betting request receiving unit 26 then determines whether or not the identified value of the impact score is equal to or higher than a given threshold (5, for example) (S102). Under the condition that the impact score is equal to or higher than the threshold (S102: Y), the betting request receiving unit 26 adds (enqueues) the processing order management data 42 that is associated with the received betting request to the head of the betting request management queue 40 (S103). On the other hand, under the condition that the impact score is lower than the threshold (S102: N), the betting request receiving unit 26 adds (enqueues) the processing order management data 42 that is associated with the received request to the tail end of the betting request management queue 40 (S104). After the processing of S103 or S104 is finished, the betting request receiving unit 26 sets the value of the impact score identified in the processing of S101 as the value of the impact score included in the processing order management data 42 (S105).

Figures 6, 7:
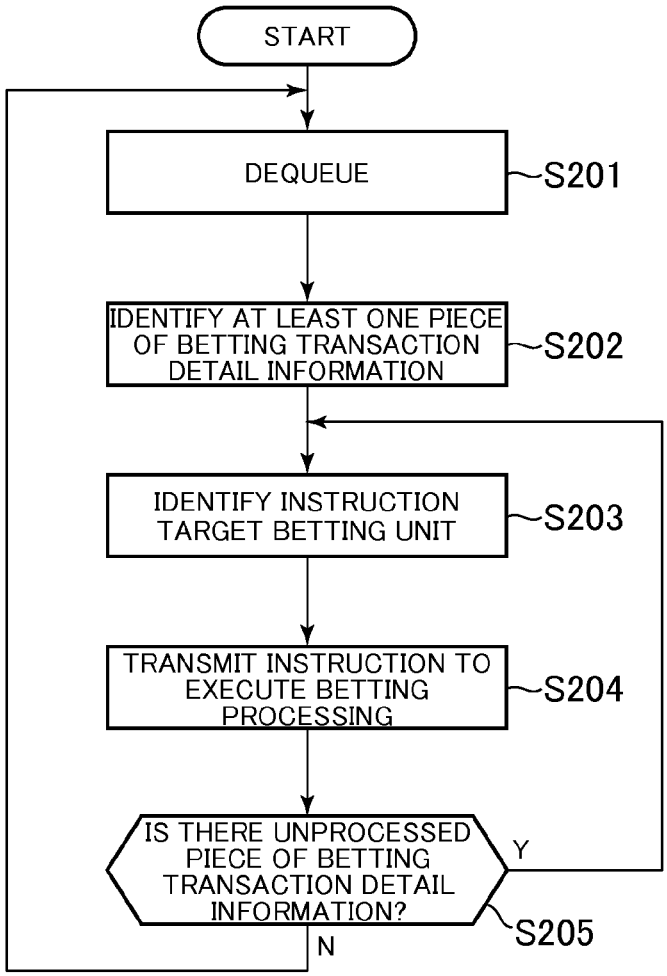
FIG. 6 is a flow chart illustrating an example of the flow of processing that is executed in the horse race betting ticket purchase mediation system according to the embodiment of the present invention.
FIG. 7 is a diagram illustrating an example of impact level calculation basic data.

A description is now given with reference to a flow chart of FIG. 6 of an example of the flow of processing that is executed by the horse race betting ticket purchase mediation system 10 according to this embodiment to transmit abetting request execution instruction.

At first, the processing unit 28 obtains (dequeues) the processing order management data 42 that is at the head of the betting request management queue 40 (S201). The processing unit 28 identifies at least one piece of the betting transaction detail information 30 that is stored in the data storage unit 20 and that is associated with the processing order management data 42 obtained in the processing of S201 (S202). The processing unit 28 then identifies, as an instruction target betting unit, a betting unit that is associated with one piece of the betting transaction detail information 30 out of pieces of betting transaction detail information 30 that have been identified in the processing of S202 and that have not been processed by processing of S204 which is described later (for example, a betting unit that is associated with a piece of the betting transaction detail information 30 that has the smallest serial betting case number of pieces of the betting transaction detail information 30 that have not been processed by processing of S204 described later) (S203). The processing unit 28 transmits to the horse race management system 12 an instruction to execute betting processing for the instruction target betting unit (S204). The processing unit 28 then determines whether or not there is a piece of the betting transaction detail information 30 that has been identified in the processing of S202 and that has not been processed by the processing of S204 (unprocessed piece of the betting transaction detail information 30) (S205). Under the condition that there is unprocessed information (S205: Y), the processing of S203 is executed. Under the condition that there is no unprocessed information (S205: N), the processing unit 28 ends the processing of this processing example. In this embodiment, the processing of S201 to the processing of S205 are repeated until the horse race betting ticket purchase mediation system 10 receives a request to end this processing. The flow of betting request processing is not limited to the exemplary flow illustrated in FIG. 6.

A wide range of variations can be thought of for the processing of identifying the value of the impact score in the processing of S101 described above. For instance, the data storage unit 20 may store impact level calculation base data 44 an example of which is illustrated in FIG. 7 and which associates a range of the latest odds with a value of the impact score. The impact level calculation base data 44 here sets a larger value as the value of the impact score under the condition that the latest odds are greater as illustrated in FIG. 7. The betting request receiving unit 26 in this case identifies a combination (may be a plurality of combinations) of a race and a bet selection that is specified in a received betting request. The betting request receiving unit 26 next identifies the latest odds that is associated with the identified combination in the latest odds data (in the case where a plurality of combinations have been identified, the latest odds that have the largest value of the latest odds associated with those combinations). The betting request receiving unit 26 then identifies a value of the impact score that is associated with a range containing the identified latest odds in the impact level calculation base data 44. The value of the impact score is identified in this manner.

To give another example, the data storage unit 20 may store the impact level calculation base data 44 that associates a forecast mark (favorite, contender, long shot, or the like) with a value of the impact score, and also store data that indicates an association relation between the combination described above and a forecast mark (for example, a forecast mark on the day's newspaper). The impact level calculation base data 44 here sets a larger value as the value of the impact score for the combination that is specified in advance as being likely to have greater odds. More specifically, the impact level calculation base data 44 sets the impact score so that the value of the impact score increases in the order of favorite, contender, long shot, for example. The betting request receiving unit 26 in this case identifies a forecast mark associated with a combination of a race and a bet selection that is specified in a received betting request. The betting request receiving unit 26 then identifies a value of the impact score that is associated with the identified forecast mark in the impact level calculation base data 44.

To give still another example, the data storage unit 20 may store the impact level calculation base data 44 that associates a range of the bet amount with a value of the impact score. The impact level calculation base data 44 here sets a larger value as the value of the impact score under the condition that the bet amount is greater. The betting request receiving unit 26 in this case identifies a value of the impact score that is associated with a range containing a bet amount of a received betting request in the impact level calculation base data 44.

The horse race management system 12 executes betting processing in response to an execution instruction that is received from the horse race betting ticket purchase mediation system 10 according to this embodiment. As mentioned above, the horse race management system 12 also executes betting processing in response to execution instructions that are received from other systems than the horse race betting ticket purchase mediation system 10. The horse race management system 12 in this embodiment executes betting processing in the order of reception of execution instructions.

Under the condition that the betting processing that has been executed in response to an execution instruction received from the horse race betting ticket purchase mediation system 10 is finished, the horse race management system 12 transmits to the horse race betting ticket purchase mediation system 10 a message to the effect that the betting processing has been completed, along with information for identifying the execution instruction (e.g., a combination of a processed date, a reception number, and a serial betting case number) and a reception established date/time indicating the date/time of execution of the betting processing. The processing unit 28 receives the message informing of the completion of the betting processing, and sets the reception established date/time received from the horse race management system 12 as the value of a reception established date/time included in the betting transaction detail information 30 that is associated with this betting processing.

In this embodiment, the value of the impact score is identified based on betting requests received by the betting request receiving unit 26, and a betting request that has a higher value of the impact score is processed before one that has a lower impact score. The possibility of the latest odds reflecting the specifics a betting request that changes the odds greatly is therefore stronger than in the case where betting requests are processed in the received order, and users can quickly be informed of a change in the odds.

The present invention is not limited to the embodiment described above.

For instance, the horse race betting ticket purchase mediation system 10 according to this embodiment may include a monitoring unit for monitoring the betting request management queue 40. The monitoring unit may sort, at given time intervals (one-minute intervals), for example, pieces of the processing order management data 42 contained in the betting request management queue 40 so that the pieces of the processing order management data 42 are arranged in the descending order of the value of the impact score associated with the processing order management data 42. Alternatively, the monitoring unit may check, at given time intervals (one-minute intervals), whether or not a value of the impact score associated with the processing order management data 42 is equal to or higher than a given threshold for the pieces of the processing order management data 42 in order, starting at the second piece of the processing order management data 42 from the head. A piece of the processing order management data 42 that is confirmed to be associated with an impact score equal to or higher than the given threshold may change places with a piece of the processing order management data 42 that is right in front of the confirmed piece in the betting request management queue 40. Before executing the processing described above, the monitoring unit may recalculate the value of the impact score for at least some of pieces of the processing order management data 42 that are contained in the betting request management queue 40.

To give another example, the betting request receiving unit 26 may calculate the value of the impact score by a given mathematical expression.

The impact score can be, for example, (abet amount)/(the total amount of bets that have been placed for a bet selection that is abet target in question) or (abet amount)/(an average of bet amounts in the last N betting requests received).

To give still another example, the betting request receiving unit 26 may identify as the value of the impact score a difference between A and B, where A equals (P1: a bet amount in question)/(P2: an amount obtained by selecting one bet (e.g., the latest bet) for each bet selection and summing up bet amounts in the selected bets of all bet selections), and B equals (P3: the sum of bet amounts for a bet selection that is a betting target in question)/(P4: the sum of bet amounts in a race that is a betting target in question). Alternatively, the betting request receiving unit 26 may identify as the value of the impact score a ratio of A to B, a logarithm of the ratio of A to B, or the like. In calculating P2 described above, the betting request receiving unit 26 may select a bet in question for a bet selection that is a betting target in question. In calculating P2 and P4 described above, the betting request receiving unit 26 may limit the range of bet amounts that are summed up so that only bet amounts of bet selections that have the same betting method (method type) as that of a bet selection that is a betting target in question are summed up.

To give yet still another example, the monitoring unit may monitor for whether or not a condition that the count of unprocessed betting requests is equal to or larger than a given number X is satisfied. In the case where this condition is satisfied, the betting request receiving unit 26 may add (enqueue) a piece of the processing order management data 42 that is associated with a betting request for a race that is not nearing its betting deadline to the tail end of the betting request management queue 40 irrespective of the value of the impact score.

The horse race betting ticket purchase mediation system 10, the horse race management system 12, and the user terminals 14 are not limited to the role allotment described above. For instance, the horse race betting ticket purchase mediation system 10 may additionally include the functions of horse race management system 12 so that the processing unit 28 executes betting processing.

This embodiment maybe applied to other scenes than the purchase of a horse race betting ticket (e.g., the purchase of a boat race betting ticket, a bicycle race betting ticket, an auto race betting ticket, a football betting ticket, or a lottery). The concrete numerical values and texts given above, and the concrete numerical values and texts in the drawings are merely examples, and the present invention is not limited to those numerical values and texts.

The invention claimed is:

1. A betting ticket purchase system, comprising:

receiving means for receiving a plurality of betting ticket purchase requests each having a bet selection specified therein;

execution requesting means for sequentially requesting betting processing means to execute betting processing on the plurality of betting ticket purchase requests received by the receiving means based on processing order management data of a betting request management queue;

obtaining means for obtaining odds of each bet selection which are calculated in the betting processing executed by the betting processing means;

identifying means for referring to storing means for storing data representing a correspondence relation between the odds and an impact level indicating a level of impact of each bet selection on the odds to identify, based on the bet selection specified in each of ones of the plurality of betting ticket purchase requests on which the betting processing is executed, the odds of each bet selection which are calculated in the betting processing, and the bet selection specified in each of ones of the plurality of betting ticket purchase requests on which the betting processing means is yet to be requested to execute the betting processing, the level of impact of the each of the ones of the plurality of betting ticket purchase requests on which the betting processing means is yet to be requested to execute the betting processing on the odds of each bet selection; and setting means for setting in the betting request management queue, as the processing order management data, an order in which the execution requesting means requests the betting processing means to execute the betting processing so that as the level of impact of one of the plurality of betting ticket purchase requests which is identified by the identifying means becomes larger, the one of the plurality of betting ticket purchase requests is processed earlier in the betting processing executed by the betting processing means.

2. The betting ticket purchase system according to claim 1, wherein the setting means sets a processing order of one of the plurality of betting ticket purchase requests so that the one of the plurality of betting ticket purchase requests is processed first among unprocessed betting ticket purchase requests when the level of impact of the one of the plurality of betting ticket purchase requests on the odds is higher than a predetermined level, and otherwise sets the processing order so that the one of the plurality of betting ticket purchase requests is processed last among the unprocessed betting ticket purchase requests.

3. The betting ticket purchase system according to claim 1, wherein, when a processing order of a first betting ticket purchase request is set so that the first betting ticket purchase request is processed later than a second betting ticket purchase request which is identified as being smaller in impact on the odds than the first betting ticket purchase request, the setting means changes places of the first betting ticket purchase request and the second betting ticket purchase request in the processing order.

4. The betting ticket purchase system according to claim 1, wherein the setting means sets a processing order of one of the plurality of betting ticket purchase requests so that the one of the plurality of betting ticket purchase requests is processed before one of the plurality of betting ticket purchase requests for a bet selection whose odds obtained from the obtaining means are lower than the odds of the one of the plurality of betting ticket purchase requests.

5. The betting ticket purchase system according to claim 1, wherein the setting means sets a processing order of one of the plurality of betting ticket purchase requests so that the one of the plurality of betting ticket purchase requests is processed before one of the plurality of betting ticket purchase requests that is specified in advance as being lower in odds than the one of the plurality of betting ticket purchase requests.

6. The betting ticket purchase system according to claim 1, wherein the setting means sets a processing order of one of the plurality of betting ticket purchase requests so that the one of the plurality of betting ticket purchase requests is processed before one of the plurality of betting ticket purchase requests that is lower in bet amount than the one of the plurality of betting ticket purchase requests.

7. The betting ticket purchase system according to claim 1, wherein, when there are more unprocessed betting ticket purchase requests than a given number, the setting means sets a processing order of one of the plurality of betting ticket purchase requests received by the receiving means so that the one of the plurality of betting ticket purchase requests is processed last among the unprocessed betting ticket purchase requests irrespective of the level of impact of the one of the plurality of betting ticket purchase requests on the odds.

8. A method of controlling a betting ticket purchase system, the method comprising:

a receiving step of receiving a plurality of betting ticket purchase requests each having a bet selection specified therein;

an execution requesting step of sequentially requesting betting processing means to execute betting processing on the plurality of betting ticket purchase requests received in the receiving step based on processing order management data of a betting request management queue;

an obtaining step of obtaining odds of each bet selection which are calculated in the betting processing executed by the betting processing means;

an identifying step of referring to storing means for storing data representing a correspondence relation between the odds and an impact level indicating a level of impact of each bet selection on the odds to identify, based on the bet selection specified in each of ones of the plurality of betting ticket purchase requests on which the betting processing is executed, the odds of each bet selection which are calculated in the betting processing, and the bet selection specified in each of ones of the plurality of betting ticket purchase requests on which the betting processing means is yet to be requested to execute the betting processing, the level of impact of the each of the ones of the plurality of betting ticket purchase requests on which the betting processing means is yet to be requested to execute the betting processing on the odds of each bet selection; and a setting step of setting in the betting request management queue, as the processing order management data, an order in which the betting processing means is requested to execute the betting processing in the execution requesting step so that as the level of impact of one of the plurality of betting ticket purchase requests which is identified in the identifying step becomes larger, the one of the plurality of betting ticket purchase requests is processed earlier in the betting processing executed by the betting processing means.

9. A non-transitory recording medium having recorded thereon a program for causing a computer to function as:

receiving means for receiving a plurality of betting ticket purchase requests each having a bet selection specified therein;

execution requesting means for sequentially requesting betting processing means to execute betting processing on the plurality of betting ticket purchase requests received by the receiving means based on processing order management data of a betting request management queue;

obtaining means for obtaining odds of each bet selection which are calculated in the betting processing executed by the betting processing means;

identifying means for referring to storing means for storing data representing a correspondence relation between the odds and an impact level indicating a level of impact of each bet selection on the odds to identify, based on the bet selection specified in each of ones of the plurality of betting ticket purchase requests on which the betting processing is executed, the odds of each bet selection which are calculated in the betting processing, and the bet selection specified in each of ones of the plurality of betting ticket purchase requests on which the betting processing means is yet to be requested to execute the betting processing, the level of impact of the each of the ones of the plurality of betting ticket purchase requests on which the betting processing means is yet to be requested to execute the betting processing on the odds of each bet selection; and setting means for setting in the betting request management queue, as the processing order management data, an order in which the execution requesting means requests the betting processing means to execute the betting processing so that as the level of impact of one of the plurality of betting ticket purchase requests which is identified by the identifying means becomes larger, the one of the plurality of betting ticket purchase requests is processed earlier in the betting processing executed by the betting processing means.

10. A betting ticket purchase system, comprising:

receiving means for receiving a plurality of betting ticket purchase requests each having a bet selection specified therein;

execution requesting means for sequentially requesting betting processing means to execute betting processing on the plurality of betting ticket purchase requests received by the receiving means based on processing order management data of a betting request management queue;

obtaining means for obtaining odds of each bet selection which are calculated in the betting processing executed by the betting processing means;

identifying means for referring to storing means for storing, in association with each bet selection, data representing a level of impact of the each bet selection on the odds to identify the level of impact of each of ones of the plurality of betting ticket purchase requests on which the betting processing means is yet to be requested to execute the betting processing on the odds of each bet selection; and setting means for setting in the betting request management queue, as the processing order management data, an order in which the execution requesting means requests the betting processing means to execute the betting processing so that as the level of impact of one of the plurality of betting ticket purchase requests which is identified by the identifying means becomes larger, the one of the plurality of betting ticket purchase requests is processed earlier in the betting processing executed by the betting processing means.

11. A method of controlling a betting ticket purchase system, the method comprising:

a receiving step of receiving a plurality of betting ticket purchase requests each having a bet selection specified therein;

an execution requesting step of sequentially requesting betting processing means to execute betting processing on the plurality of betting ticket purchase requests received in the receiving step based on processing order management data of a betting request management queue;

an obtaining step of obtaining odds of each bet selection which are calculated in the betting processing executed by the betting processing means;

an identifying step of referring to storing means for storing, in association with each bet selection, data representing a level of impact of the each bet selection on the odds to identify the level of impact of each of ones of the plurality of betting ticket purchase requests on which the betting processing means is yet to be requested to execute the betting processing on the odds of each bet selection; and a setting step of setting in the betting request management queue, as the processing order management data, an order in which the betting processing means is requested to execute the betting processing in the execution requesting step so that as the level of impact of one of the plurality of betting ticket purchase requests which is identified in the identifying step becomes larger, the one of the plurality of betting ticket purchase requests is processed earlier in the betting processing executed by the betting processing means.

12. A non-transitory recording medium having recorded thereon a program for causing a computer to function as:

receiving means for receiving a plurality of betting ticket purchase requests each having a bet selection specified therein;

execution requesting means for sequentially requesting betting processing means to execute betting processing on the plurality of betting ticket purchase requests received by the receiving means based on processing order management data of a betting request management queue;

obtaining means for obtaining odds of each bet selection which are calculated in the betting processing executed by the betting processing means;

identifying means for referring to storing means for storing, in association with each bet selection, data representing a level of impact of the each bet selection on the odds to identify the level of impact of each of ones of the plurality of betting ticket purchase requests on which the betting processing means is yet to be requested to execute the betting processing on the odds of each bet selection; and setting means for setting in the betting request management queue, as the processing order management data, an order in which the execution requesting means requests the betting processing means to execute the betting processing so that as the level of impact of one of the plurality of betting ticket purchase requests which is identified by the identifying means becomes larger, the one of the plurality of betting ticket purchase requests is processed earlier in the betting processing executed by the betting processing means.

* * * * *